US006752077B2

(12) United States Patent
Kolbe et al.

(10) Patent No.: US 6,752,077 B2
(45) Date of Patent: Jun. 22, 2004

(54) PRINTING PRESS WITH A DOCTOR BLADE DEVICE

(75) Inventors: Wilfried Kolbe, Gülzow (DE); Klaus Schirrich, Bielefeld (DE); Andreas Kückelmann, Ibbenbüren (DE)

(73) Assignee: Fischer & Krecke GmbH & Co., Bielefeld (DE)

( * ) Notice: Subject to any disclaimer, the term of this patent is extended or adjusted under 35 U.S.C. 154(b) by 0 days.

(21) Appl. No.: 10/427,101

(22) Filed: May 1, 2003

(65) Prior Publication Data

US 2003/0213386 A1 Nov. 20, 2003

(30) Foreign Application Priority Data

May 18, 2002 (EP) ..... 02011106

(51) Int. Cl.[7] ..... B41F 9/10; B41F 31/02

(52) U.S. Cl. ..... 101/169; 101/350.3; 15/256.51

(58) Field of Search ..... 101/157, 167, 101/169, 363–366, 350.3; 15/256.51, 256.53; 118/261, 245, 413, 657

(56) References Cited

U.S. PATENT DOCUMENTS 3,087,184 A * 4/1963 Ljungquist ..... 15/256.51
3,105,779 A * 10/1963 Bul et al. ..... 134/1
3,113,225 A * 12/1963 Kleesattel et al. ..... 101/169
3,389,655 A 6/1968 Lorenz et al.
3,964,386 A * 6/1976 Dini ..... 101/169
4,515,078 A * 5/1985 Difflipp et al. ..... 101/157
4,716,826 A * 1/1988 Gibellino et al. ..... 101/169
4,896,625 A * 1/1990 Sakamoto et al. ..... 118/657
5,121,689 A * 6/1992 Fadner ..... 101/365
5,226,364 A * 7/1993 Fadner ..... 101/366
5,388,515 A * 2/1995 Schneider et al. ..... 101/163
5,671,673 A * 9/1997 Bööse et al. ..... 101/157
6,203,962 B1 * 3/2001 Itami et al. ..... 430/125
2002/0162466 A1 * 11/2002 Schonberger ..... 101/350.3

FOREIGN PATENT DOCUMENTS

| | | |
|---|---|---|
| DE | 630567 | 10/1949 |
| DE | 3907483 | 9/1990 |
| DE | 10044092 | 4/2001 |

OTHER PUBLICATIONS

Patent Abstracts of Japan, vol. 2000, No. 06, Sep. 22, 2000, Toppan Printing Co. Ltd., Mar. 28, 2000, inventor Shimamura Yoshikazu.

* cited by examiner

*Primary Examiner*—Eugene H. Eickholt
(74) *Attorney, Agent, or Firm*—Richard M. Goldberg

(57) ABSTRACT

A printing press with a doctor blade device (24), which has a doctor blade (26), which can be placed against a cylinder (10), wherein the doctor blade (26) is caused to oscillate with a frequency of at least 1 Hz by an oscillator (38).

11 Claims, 1 Drawing Sheet

PRINTING PRESS WITH A DOCTOR BLADE DEVICE

BACKGROUND OF THE INVENTION

The invention relates to a printing press with a doctor blade device, which has a doctor blade, which can be placed against a cylinder.

In printing presses, doctor blade devices are generally used to scrape the surface of a rotating cylinder, for example, of the printing cylinder, with the help of a doctor blade. For example, in a gravure printing press, such a doctor blade device has the function of scraping clean the smoothly polished surface of the gravure printing cylinder after the inking and before the actual printing process, so that the printing ink remains only in the printing, recessed regions of the printing cylinder surface. It may, however, happen that dust particles, dried residues of ink or other dirt particles build up in front of the edge of the doctor blade and then reach the printing recesses of the gravure cylinder and affect the printed image. In order to solve this problem, it is known that a transverse motion, transversely to the direction of rotation, that is, in the axial direction, be imparted to the doctor blade. The transverse component of the relative motion between the doctor blade and the printing cylinder then contributes to removing impurities from the recesses or detaching them from the doctor blade, so that they are washed away with the printing ink and do not reach the recesses of the printing cylinder at all.

Usually, the doctor blade is moved with constant speed in the axial direction. However, the direction of motion must be reversed from time to time, typically after a few seconds, so that the doctor blade carries out only a limited travel, for example, of a few millimeters or centimeters. The greater this travel, the further does the doctor blade have to protrude over the ends of the printing cylinder. A relatively expensive mechanism is required to drive and control the transverse motion of the doctor blade. In addition, the overhang of the doctor blade and its transverse motion cause printing ink to drip from the ends of the doctor blade. These drips have to be collected with expensive collecting equipment.

SUMMARY OF THE INVENTION

It is an object of the invention to provide a printing press with a doctor blade device, with which, with a simplified construction, a high printing quality can be achieved.

Pursuant to the invention, this objective is accomplished by an oscillator, which oscillates the doctor blade with a frequency of at least 1 Hz.

Due to the comparatively high frequency of the oscillator, a significantly shorter travel of the doctor blade is achieved at the same average velocity, so that the doctor blade has to protrude less wide over the cylinder. Since the movement of the doctor blade is a forced oscillation with a short travel, the control of the course of the movement is simplified significantly and the suspension or guidance for the doctor blade can also be significantly simplified structurally. In addition, since the acceleration of the doctor blade is proportional to the square of the frequency, significantly higher accelerations are achieved with the inventive device because of the high frequency. Accordingly, a higher acceleration is imparted to the dirt particles by the doctor blade, so that these particles are detached more efficiently.

Advantageous developments of the invention arise out of the dependent claims.

Preferably, the oscillator is formed by an acoustic oscillator, which generates oscillations with the desired frequency in the infrasound range (1 to 15 Hz), in the audible range (15 Hz to 20 kHz) or the ultrasound range, which is particularly preferred. The acoustic oscillator can be structurally very simple and can be formed, for example, by a conventional, electromagnetic transducer, a piezoelectric transducer or the like.

The oscillator may produce oscillations in the longitudinal direction of the doctor blade and/or in the direction perpendicular to the plane of the doctor blade. Since, in the final analysis, only the relative motion matters, it is also conceivable to have the oscillator act on the cylinder.

Due to an asymmetric (for example, sawtooth-like) oscillation pattern, a transport effect can be achieved similar to that of a vibrating conveyor, so that the dirt particles can be removed even more efficiently. For the same purpose, it is also possible to cause the doctor blade to oscillate elliptically.

The higher the selected frequency of the oscillator, the smaller, in general, is the travel, which can be selected. If the travel is sufficiently small, the necessary mobility of the doctor blade can be achieved on the basis of the inherent elasticity of the mechanical suspension or of the doctor blade alone, so that expensive mechanisms for the mobile support and guidance of the doctor blade are no longer required.

If the travel of the doctor blade is selected to be smaller than the resolution capability of the human eye, of, for example of 0.2 mm or less, it is also ensured that the vibration of the doctor blade does not leave any visible traces in the printed image.

At higher frequencies, at which, in spite of the high velocity of sound in solids (about 5,000 m/s), the sound wavelength becomes smaller than the length of the doctor blade, it may be appropriate to modulate the oscillation frequency or to superimpose several anharmonic frequencies, so that permanent oscillation nodes do not develop over the length of the doctor blade. Alternatively, such oscillation nodes can also be suppressed by attenuating the sound waves at the end of the doctor blade, opposite to the oscillator, so that, essentially, reflections are not formed and a moving wave is obtained instead of a standing one.

BRIEF DESCRIPTION OF THE DRAWINGS

In the following, examples are explained in greater detail by means of the drawing, in which.

DETAILED DESCRIPTION

Figure 1:
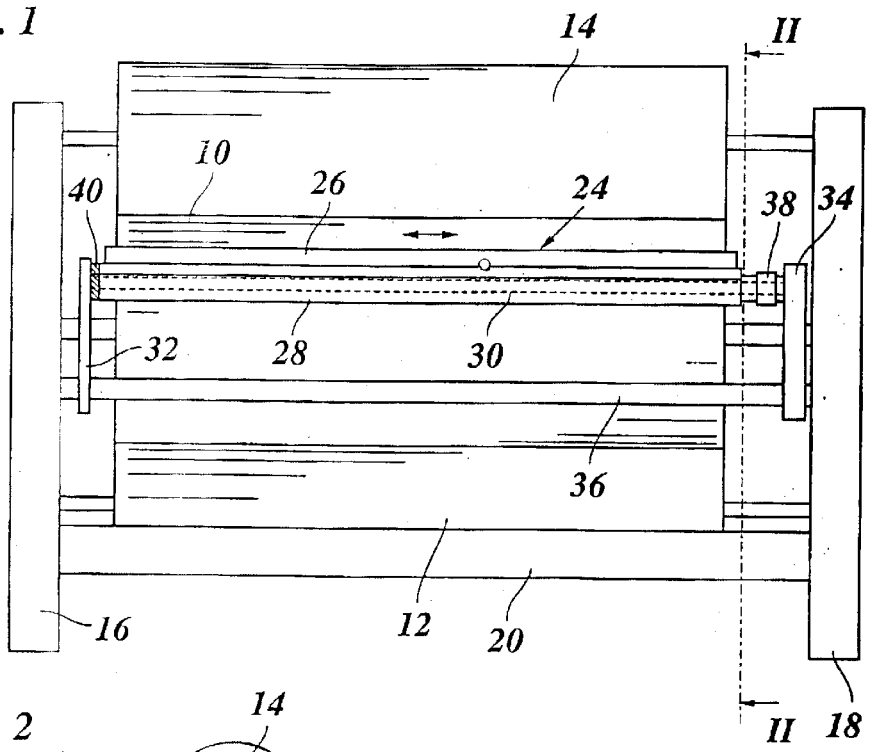
FIG. 1 shows a diagrammatic view of a gravure printing press.

The gravure printing press, shown in FIG. 1, comprises a gravure cylinder 10, an inking roller 12 and an impression roller 14, which are mounted rotatably between side parts 16, 18 of a machine frame. The associated driving and adjusting devices are not shown here, since they are not essential for understanding the invention.

Figure 2:
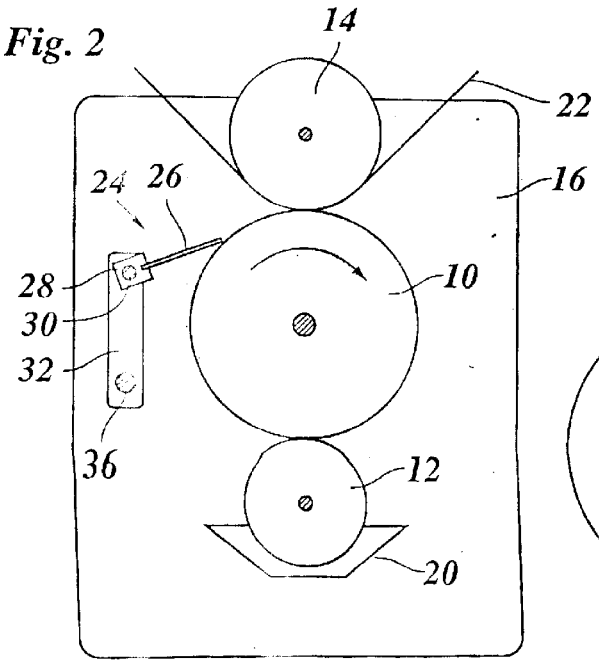
FIG. 2 shows a diagrammatic section along the line II—II in FIG. 1

The top of the inking roller 12 is in contact with the gravure cylinder 10 and, with its bottom side, dips into the ink pan 20, as can be seen clearly in FIG. 2. The inking roller 12 takes up printing ink from the ink pan 20 and transfers it to the peripheral surface of the gravure cylinder 10, which rotates in the direction of the arrow in FIG. 2 and transfers printing ink to a printing substrate sheet 22, which passes between the impression roller 14 and the gravure cylinder and is pressed by the impression roller against the gravure cylinder.

A doctor blade device 24 is assigned to the gravure cylinder 10. This doctor blade device is formed in a known manner by a doctor blade 26, which is fastened at a holder 28. The holder 28 is mounted on a shaft 30, which extends between two levers 32, 34. The lower ends of the levers 34 rest on a rotatable shaft 36, with which the whole of the doctor blade device 24 can be swiveled against the periphery of the gravure cylinder 10, so that the surface of the latter can be scraped with the blade of the doctor blade 26. In this way, the printing ink, taken up by the inking roller 12, is removed from the smooth, non-printing surface regions of the gravure cylinder 10, so that the printing ink remains behind only in the recessed regions, which produce the printed image on the printing substrate sheet 22.

On the shaft 30, between the lever 34 and the holding device 28, an oscillator 38 is inserted, which causes the holder 28, and with that, also the doctor blade 26, to oscillate at a high frequency in the direction parallel to the axis of the gravure cylinder 10, as indicated by the double arrow in FIG. 1. The oscillator 38 thus forms a transversely thrusting device, which produces a movement of the blade of the doctor blade 26, relative to the gravure cylinder 10 in the direction transversely to the running direction of the printing substrate sheet 22, that is, in the axial direction of the gravure cylinder. When the blade of the doctor blade 26 strikes dirt particles, the latter are detached by the oscillation of the doctor blade and removed with the printing ink. In this way, it is prevented that the printed image is affected by dirt particles permanently remaining in the recesses of the gravure cylinder.

The frequency of the oscillator 38 is, for example, in the ultrasonic range, so that the transverse oscillations of the doctor blade 26 have the shape of moving ultrasonic waves, which expand towards the opposite end of the doctor blade and are absorbed there by an absorber 40, which is inserted between the lever 32 and the holding device 28.

In the example shown, the lever 34, at which the oscillator 38 is supported directly, is constructed particularly rigidly so that the ultrasonic oscillations are coupled effectively to the holding device 28 and the doctor blade 26.

Since the transverse oscillations of the doctor blade are produced only with the help of the oscillator 38, expensive driving mechanisms and mechanisms for producing and controlling the transverse motion of the doctor blade are not required. Transverse oscillations can also be produced effectively, even if the holding device 28 is fastened rigidly to the shaft 30.

Figure 3:
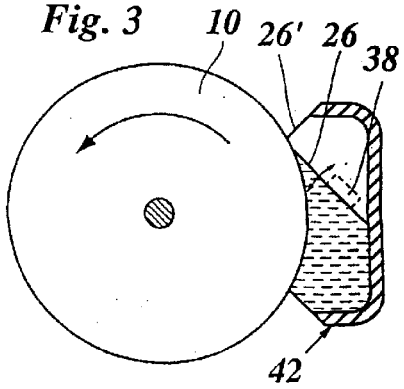
FIG. 3 shows a printing cylinder with a chambered doctor blade.

As a modified example, FIG. 3 shows a gravure cylinder 10 with a chambered doctor blade 42. The doctor blade 26 is disposed in the interior of the chambered doctor blade and is caused to oscillate predominantly in the direction perpendicular to the plane of the doctor blade by the oscillator 38, as indicated by a double arrow in FIG. 3. The oscillator 38 can be disposed outside of the chambered doctor blade, so that the oscillations are transferred to the doctor blade.

The invention can be used not only for gravure printing presses, but also for other printing presses. For example, in the case of a flexographic printing press, if the chambered doctor blade 42 is disposed at the periphery of an anilox roller, the inner doctor blade 26 would be omitted and, instead, the doctor blade 26', which terminates the doctor blade at the end, which is the rear end in the direction of rotation of the anilox roller, would be caused to oscillate.

What is claimed is:

1. A doctor blade for a printing press, comprising:

a doctor blade adapted to be placed against a cylinder of the printing press, and an oscillator for causing the doctor blade to oscillate in a direction of a longitudinal axis of the doctor blade with a frequency of at least 1 Hz, with travel of the doctor blade being less than 1 mm.

2. The doctor blade device of claim 1, wherein the oscillator is an acoustic oscillator.

3. The doctor blade device of claim 1, wherein the frequency of the oscillator is more than 5 Hz.

4. The doctor blade device of claim 3, wherein the oscillator is an ultrasonic oscillator.

5. The doctor blade device of claim 1, wherein the doctor blade is part of a chambered doctor blade.

6. The doctor blade device of claim 1, wherein the printing press is a gravure printing press.

7. A doctor blade device for a printing press, comprising:

a doctor blade adapted to be placed against a cylinder of the printing press, and an oscillator for causing the doctor blade to oscillate in a direction perpendicular to a plane of the doctor blade with a frequency of at least 1 Hz, and with travel of the doctor blade being less than 1 mm.

8. The doctor blade device of claim 7, wherein the oscillator is an acoustic oscillator.

9. The doctor blade device of claim 7, wherein the frequency of the oscillator is more than 5 Hz.

10. The doctor blade device of claim 9, wherein the oscillator is an ultrasonic oscillator.

11. A doctor blade device for a printing press, comprising:

a doctor blade adapted to be placed against a cylinder of the printing press, and an oscillator for causing the doctor blade to oscillate with a frequency of at least 1 Hz, with travel of the doctor blade being less than 0.2 mm.

* * * * *